US008136435B2

(12) United States Patent
Zhu et al.

(10) Patent No.: US 8,136,435 B2
(45) Date of Patent: Mar. 20, 2012

(54) FOOD PRODUCT SLICER KNIFE AND ASSOCIATED SLICER AND KNIFE REMOVAL TOOL

(75) Inventors: Guangshan Zhu, Richmond Hill, GA (US); Shahram Shariff, Savannah, GA (US)

(73) Assignee: Premark FEG L.L.C., Wilmington, DE (US)

( * ) Notice: Subject to any disclaimer, the term of this patent is extended or adjusted under 35 U.S.C. 154(b) by 655 days.

(21) Appl. No.: 12/281,340

(22) PCT Filed: Mar. 6, 2007

(86) PCT No.: PCT/US2007/063349

§ 371 (c)(1), (2), (4) Date: Sep. 2, 2008

(87) PCT Pub. No.: WO2007/103899

PCT Pub. Date: Sep. 13, 2007

(65) Prior Publication Data

US 2009/0013845 A1 Jan. 15, 2009

Related U.S. Application Data

(60) Provisional application No. 60/780,392, filed on Mar. 8, 2006.

(51) Int. Cl.
*B25G 3/00* (2006.01)

(52) U.S. Cl. ..... 83/707; 83/478; 83/666

(58) Field of Classification Search ..... 83/329–333, 83/337–349, 435.11, 435.15, 435.21, 478, 83/659, 663, 676, 698.41, 707, 713, 717–730, 83/932, 665, 666; 30/240

See application file for complete search history.

(56) References Cited

U.S. PATENT DOCUMENTS

| | | | | | |
|---|---|---|---|---|---|
| 1,876,075 | A | * | 9/1932 | Reichert, Jr. et al. | 30/240 |
| 1,941,840 | A | * | 1/1934 | Kelsey | 433/135 |
| 1,947,662 | A | * | 2/1934 | Robinson | 451/342 |
| 4,232,580 | A | * | 11/1980 | Stewart | 83/835 |
| 4,637,391 | A | * | 1/1987 | Schlein | 606/172 |
| 4,699,035 | A | * | 10/1987 | Gall et al. | 83/678 |
| 4,730,952 | A | * | 3/1988 | Wiley | 403/316 |
| D394,530 | S | * | 5/1998 | Roeker | D32/25 |

(Continued)

FOREIGN PATENT DOCUMENTS

EP 1598159 11/2005

(Continued)

OTHER PUBLICATIONS

PCT, International Search Report and Written Opinion, PCT/US2007/063349 (Oct. 24, 2007).

(Continued)

*Primary Examiner* — Edward Landrum
(74) *Attorney, Agent, or Firm* — Thompson Hine LLP

(57) ABSTRACT

A food product slicer knife includes a circular knife body with a peripheral cutting edge. A central opening passes through the knife body and includes a pair of diametrically opposed outwardly extending slots. The knife body also includes at least one set of diametrically opposed drive pin receiving openings spaced outwardly of the central opening and circumferentially offset from the diametrically opposed outwardly extending slots. A tool assembly is adapted to facilitate knife installation and removal and holds the knife when removed from a slicer. A food product slicer includes a knife mount hub adapted to cooperate with the knife to hold the knife on the slicer during operation.

15 Claims, 10 Drawing Sheets

U.S. PATENT DOCUMENTS

| | | | | |
|---|---|---|---|---|
| 6,439,091 | B1 * | 8/2002 | Dibbern et al. | 83/543 |
| 6,450,075 | B1 * | 9/2002 | Manzo | 83/171 |
| 6,701,629 | B2 * | 3/2004 | Krondorfer et al. | 30/390 |
| 7,033,309 | B1 * | 4/2006 | Davis | 492/14 |
| 7,387,563 | B2 * | 6/2008 | Allemann et al. | 451/342 |
| 2003/0101859 | A1 * | 6/2003 | Curtsinger et al. | 83/666 |
| 2004/0149101 | A1 | 8/2004 | Solberg | |
| 2005/0011329 | A1 * | 1/2005 | Briggs | 83/666 |
| 2005/0262980 | A1 * | 12/2005 | Matzunsky et al. | 83/341 |

FOREIGN PATENT DOCUMENTS

| | | |
|---|---|---|
| GB | 2351464 | 1/2001 |

OTHER PUBLICATIONS

PCT, International Preliminary Report on Patentability, PCT/US2007/063349 (Sep. 18, 2008).

* cited by examiner

FOOD PRODUCT SLICER KNIFE AND ASSOCIATED SLICER AND KNIFE REMOVAL TOOL

CROSS-REFERENCES

This application claims the benefit of U.S. provisional application No. 60/780,392, filed Mar. 8, 2006.

TECHNICAL FIELD

This application relates generally to a slicer having a removable slicer knife, and more particularly, to a knife, related knife mount system and knife removal tool.

BACKGROUND

Commercial food product slicers are widely utilized as rapid and effective means for slicing meat, cheese, vegetables and other food products. The slicers commonly include a rotatable, disc-like blade, and a reciprocating tray that brings the food product into contact with the rotating blade to cut a slice from the food product. Most slicers also include a movable gauge plate that adjusts the position of the food product relative the blade, which varies the thickness of the slices cut off of the food product. The gauge plate typically has a "closed" position, wherein the gauge plate is slightly raised relative the blade such that the food product cannot be cut by the blade.

Most existing slicers have the knife mounted permanently by using screws. The knife cannot be removed except by use of a conventional tool to remove the screws.

One existing slicer includes a special tool to remove knife. The knife is permanently mounted on the mounting hub by using screws, then a rotatable plate and a fixed plate are mounted on the top of the knife through another set of the screws, then the knife and mounting hub are inserted on the slicer through three spring loaded pins on the knife drive shaft. The rotatable plate has ramp features on it. By rotating the rotatable plate 90 degrees using a tool, the three pins move up, and the knife and mounting hub are held through the rotatable plate by these pins. To remove knife, the tool is inserted into the center hole, aligning three drive pins on the tool with the three notches on the rotatable plate. The rotatable plate is rotated back 90 degrees to unload from the three spring loaded pins and retreat the knife and mounting hub from pins. This design is expensive and complicated. The knife and the mounting hub are removed together, leaving an opening on the slicer, so the water could potentially flow inside to the knife drive system. The knife sharp edge is also exposed on the removal tool.

SUMMARY

In one aspect, a food product slicer knife includes a circular knife body with a peripheral cutting edge. A central opening passes through the knife body and includes a pair of diametrically opposed outwardly extending slots. The knife body also includes at least one set of diametrically opposed drive pin receiving openings circumferentially offset from the diametrically opposed outwardly extending slots.

In another aspect, a food slicer knife removal and installation tool assembly includes a base with a knife receiving side and a handle side. The base has a plurality of openings therethrough to permit water flow from the handle side to the knife receiving side. The base further includes a circumferential lip extending downwardly from knife receiving side for protecting a cutting edge of a circular slicer knife when connected thereto. A handle assembly is connected to the handle side of the base and is rotatable relative to the base. The handle assembly includes at least one knife engaging pin that is biased upward from the handle side of the base but movable through an opening in the base for engaging and securing a knife to the knife receiving side of the base.

In a further aspect, a food product slicer includes a base and a knife mount hub located on the base for rotation by a drive shaft. A knife is mounted to the knife mount hub for rotation relative to the base. A carriage assembly is mounted to the base for reciprocal movement back and forth past a cutting edge of the knife. The knife mount hub includes a central mount with a fixed portion and clamp portion movable in a direction along an axis of the drive shaft. The clamp portion is biased toward a seated position against the fixed portion. The clamp portion includes a central axis and has a peripheral edge with at least three spaced projections extending radially outwardly therefrom and beyond the outer edges of the fixed portion.

DETAILED DESCRIPTION

Figure 1:
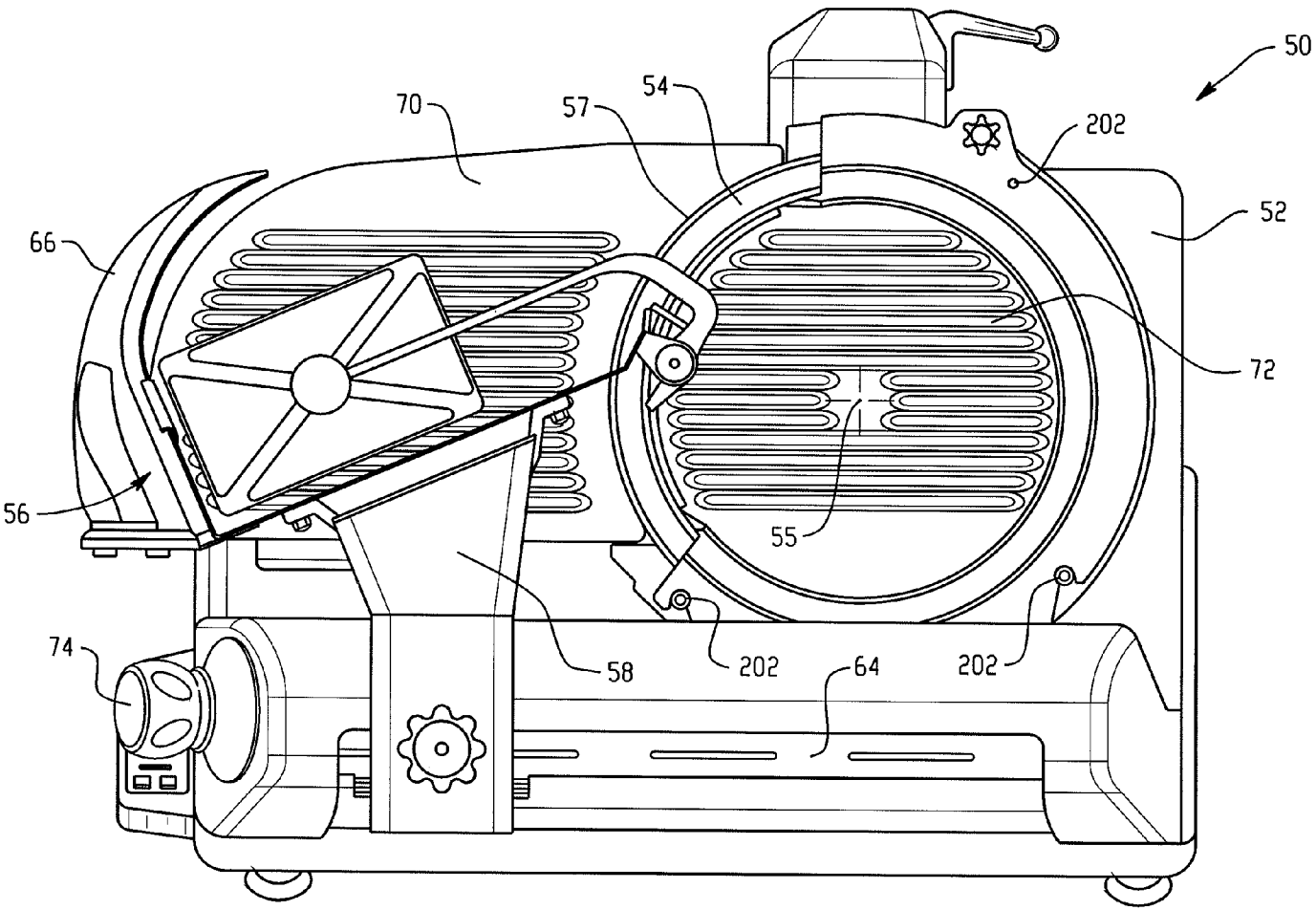
FIG. 1 is side elevation of a food product slicer.
Figure 2:
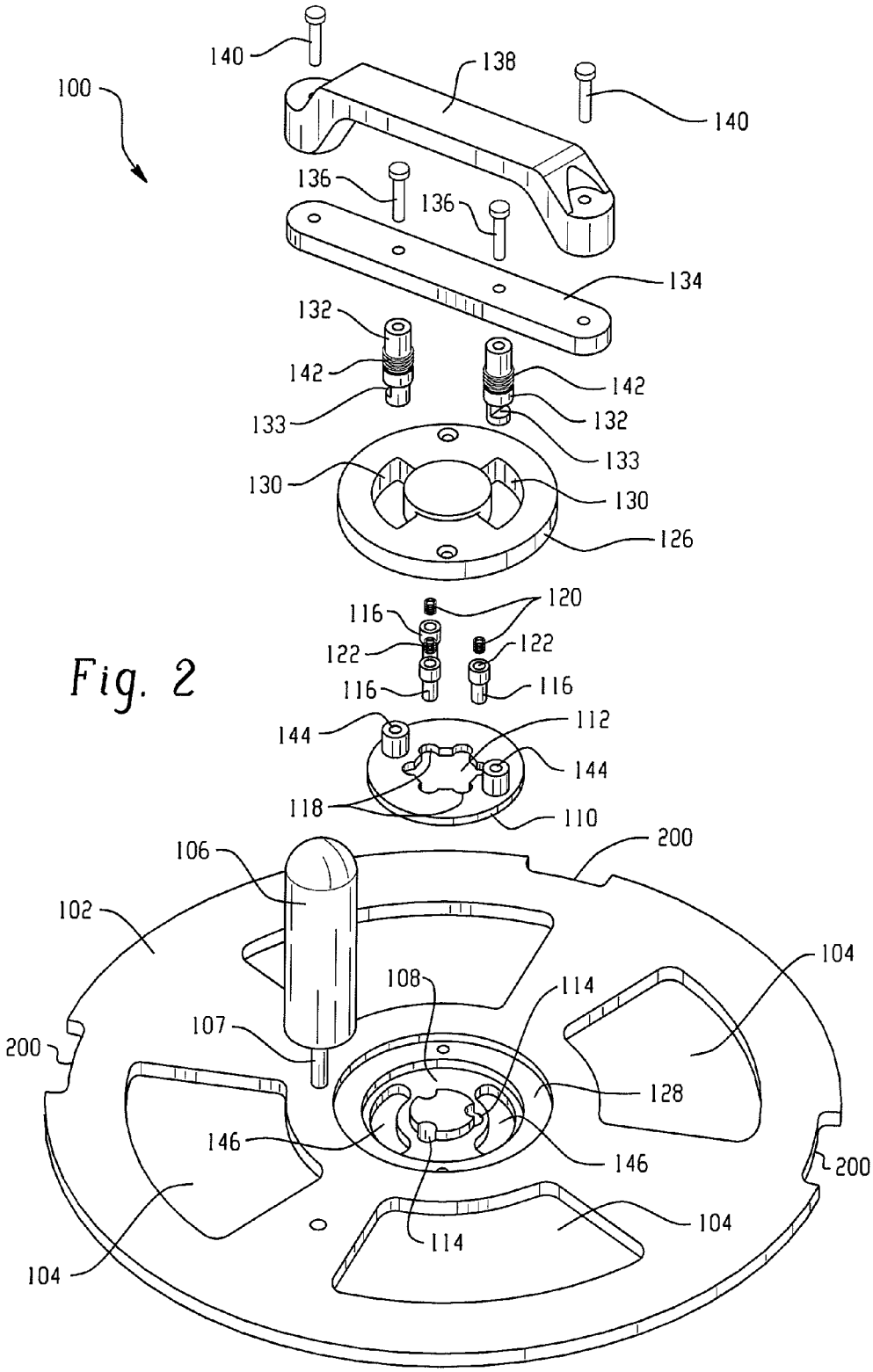
FIG. 2 is an exploded top perspective a slicer knife removal and installation tool assembly.
Figure 3:
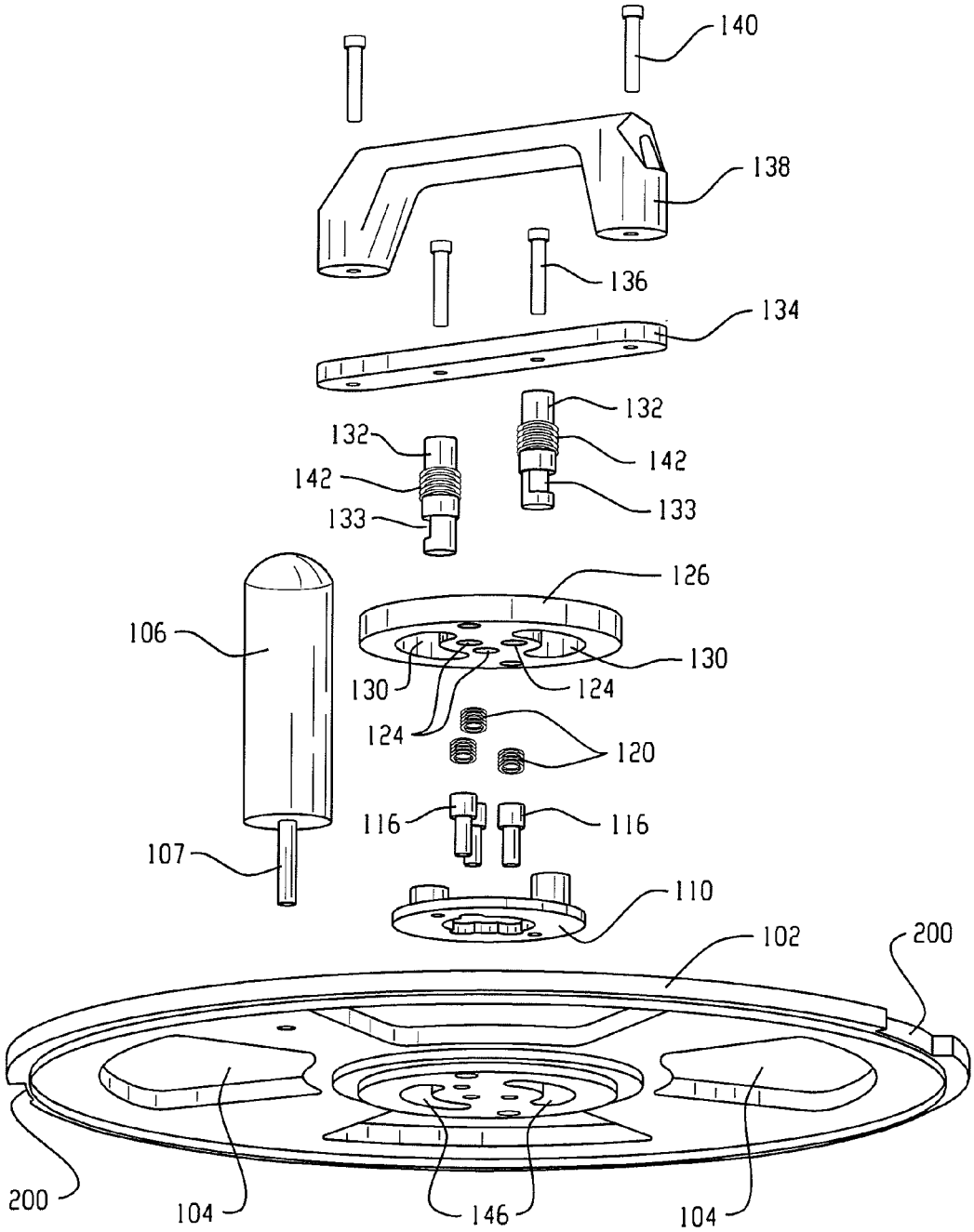
FIG. 3 is an exploded bottom perspective of the slicer knife removal and installation tool assembly.
Figure 4:
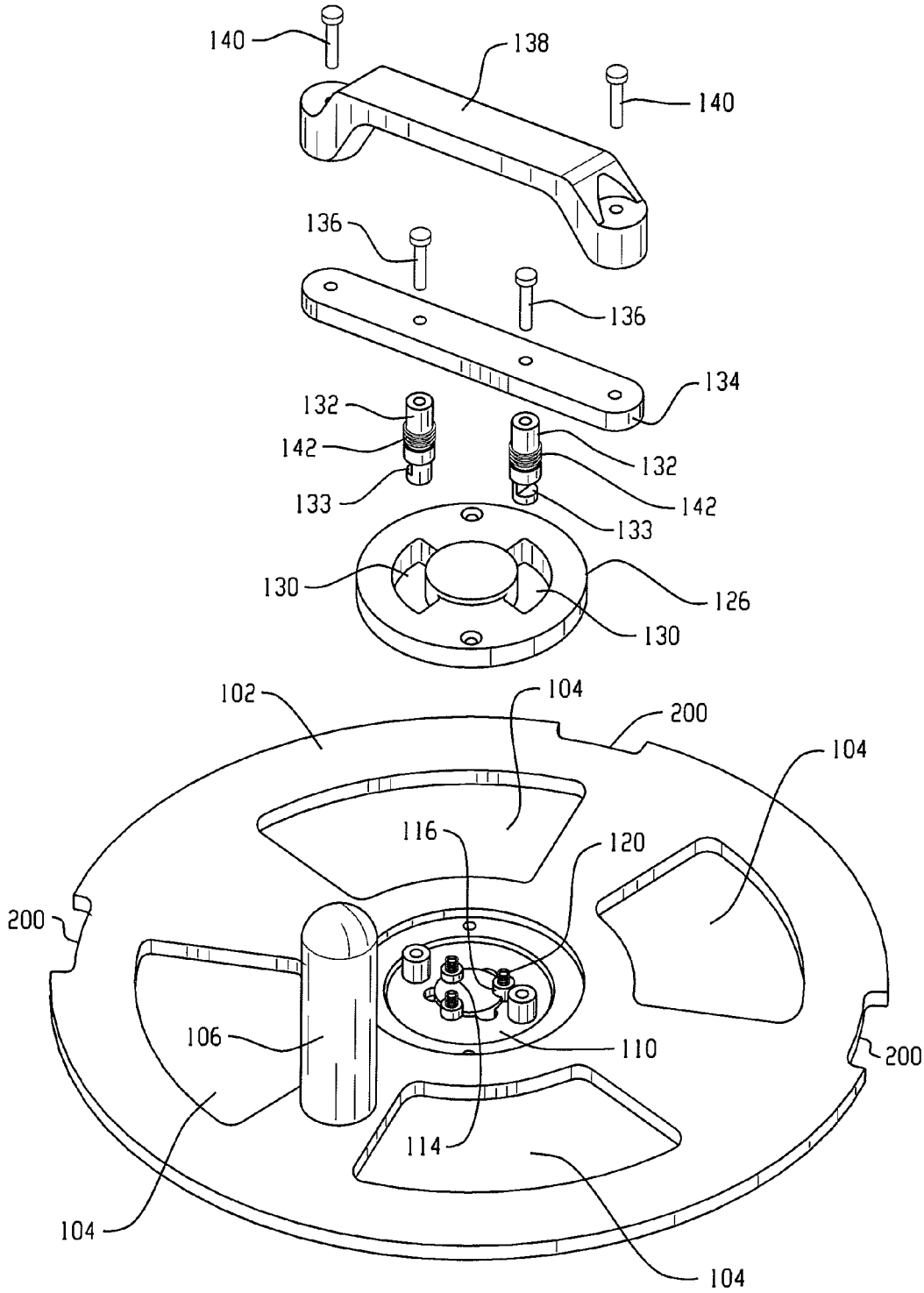
FIG. 4 is partially exploded top perspective of the slicer knife removal and installation tool assembly.
Figure 5:
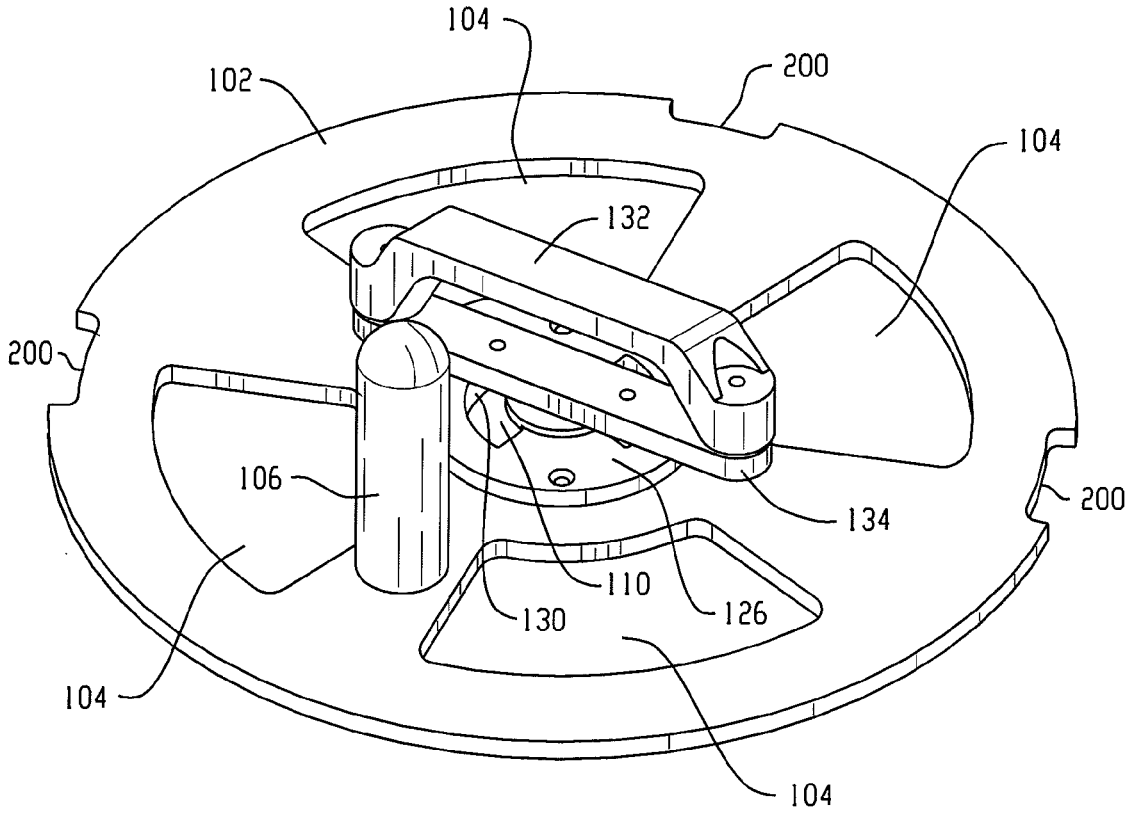
FIG. 5 is a top perspective of the assembled slicer knife removal and installation tool assembly.
Figure 6:
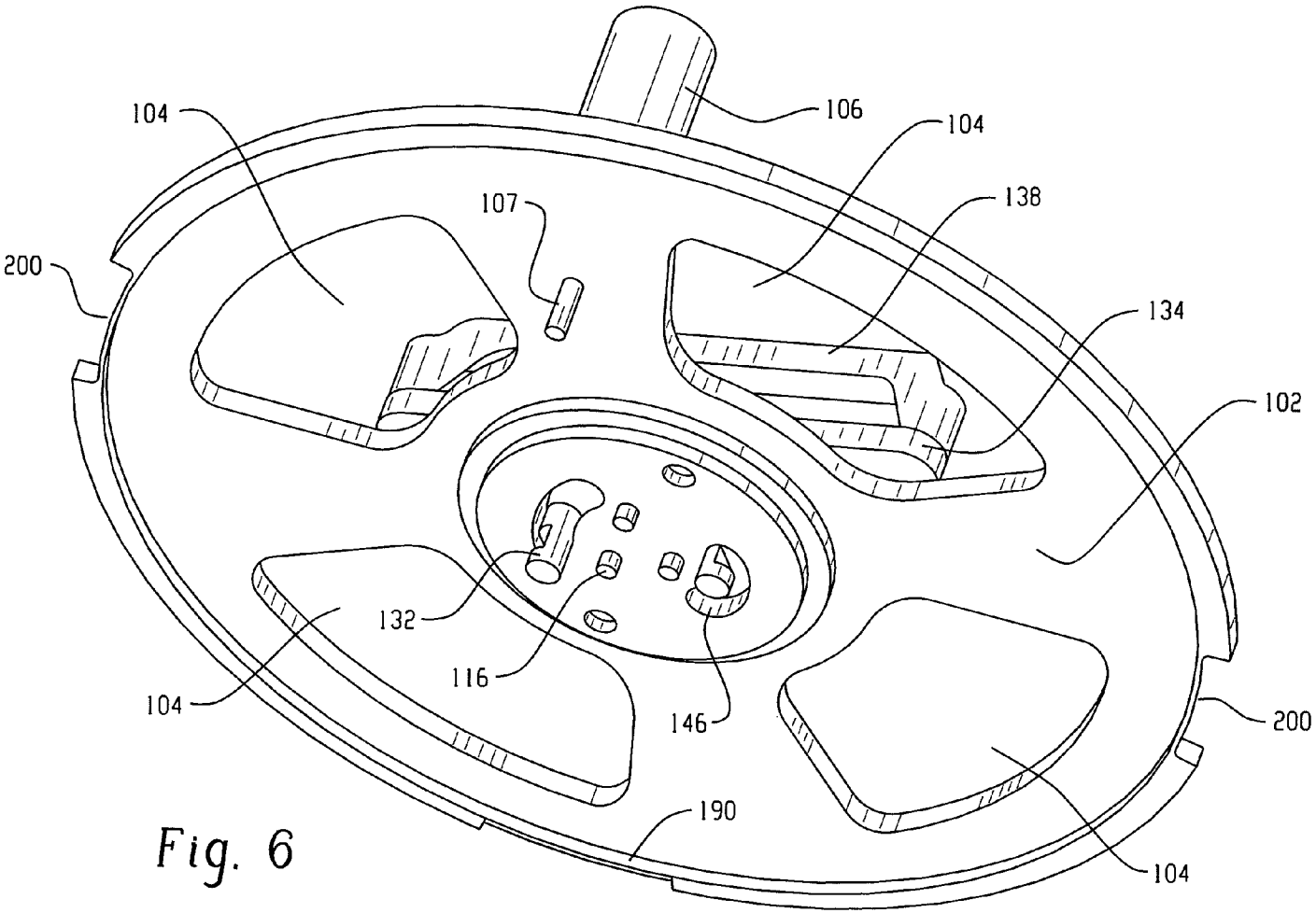
FIG. 6 is bottom perspective of the assembled slicer knife removal and installation tool assembly.

Referring to FIG. 1, a food product slicer 50 includes a housing or base 52 and a circular, motor-driven slicing knife 54 that is mounted to the housing for rotation about an axis 55. The left side of FIG. 1 is generally referred to as the front side of the slicer (which is where an operator stands for slicing), the right side of FIG. 1 is generally referred to as the rear side of the slicer and FIG. 1 depicts a right side view of the slicer. A food product can be supported on a manually operable food carriage 56 which moves the food product to be sliced past the cutting edge 57 of the rotating slicing knife 54. The food carriage 56 reciprocates from left to right relative to FIG. 1, along a linear path so that the lower end of the bulk food product slides along the surface of the gauge plate 70, is cut by the knife 54 and then slides along a knife cover plate 72. Food carriage 56 includes a tray mounted on a tray arm 58 that orients the food carriage tray at the appropriate angle (typically perpendicular) to the cutting edge plane. The food carriage reciprocates in a slot 64 at a lower portion of the housing 52 and a handle 66 is mounted to the food carriage 56. The handle is graspable by a user and can be used to manually move the food carriage. The carriage may also be automatically driven (e.g., as by a motor drive or other prime mover). A handle 74 for adjusting the gauge plate to control slice thickness is also shown.

Referring to FIGS. 2-6, a knife removal tool assembly 100 is shown. The tool includes a circular base 102 with windows 104 therein and a handle 106 connected thereto. The handle 106 includes a extended pin 107. The pin 107 extends through and beyond the base 102 for engaging with a knife opening 173 (see FIG. 10) so as to prevent relative rotation between the base 102 during installation or removal of a knife from a slicer. Referring again to FIG. 2, a central portion of the base 102 includes a circular recess 108 that receives a disc 110 with a central opening 112. Three spaced apart pin receiving openings 114 are located to receive pins 116 that pass within the disc opening 112. The upper portions of the pins are enlarged to prevent passage of the pins downward through the openings 114, with the lower portions of the pins being reduced in size. The disc opening 112 includes notched portions 118 (in the illustrated embodiment six equally spaced apart notches) that interact with the pins 116 to prevent rotation of the disc 110 when the pins 116 are in a downwardly biased position shown in FIG. 4. Referring again to FIG. 2, the pins 116 are biased downward via corresponding springs 120 that each have one end seated in an upper pin opening 122 and one end seated in a lower opening 124 (FIG. 3) of an upper disc 126. The upper surface of base 102 includes a recess 128 (FIG. 2) for receiving the disc 126, with recess 128 elevated relative to recess 108. The disc 126 is connected to the base 102 in a stationary manner (e.g., as by fasteners) and includes slots 130 through which spring-loaded pins 132 extend, with the upper ends of the pins 132 being secured to a handle base 134 via fasteners 136. A handle grip 138 is secured to the handle base via fasteners 140.

The pins 132 are spring-loaded upward via action of the springs 142 against the underside of the handle base 134 and the upper side of the disc 110. The pins 132 extend downward through boss-style openings 144 in the disc 110 and through slots 146 in the base 102. Thus, rotation of the handle via handle grip 138 will cause corresponding movement of the pins 132 along the slots 130 of disc 126, and corresponding rotation of the disc 110. However, rotation of the disc 110 and thus the handle 138 is prevented when the pins 116 are in their downwardly biased positions. Referring to the bottom view of FIG. 6, where the lower portions of the pins 116 are shown, by applying a force upward against the pins the pins can be moved upward such that the pins no longer engage with the disc notches 118 (FIG. 2), thus allowing rotation of the disc 110 via the handle grip 138.

Figure 7:
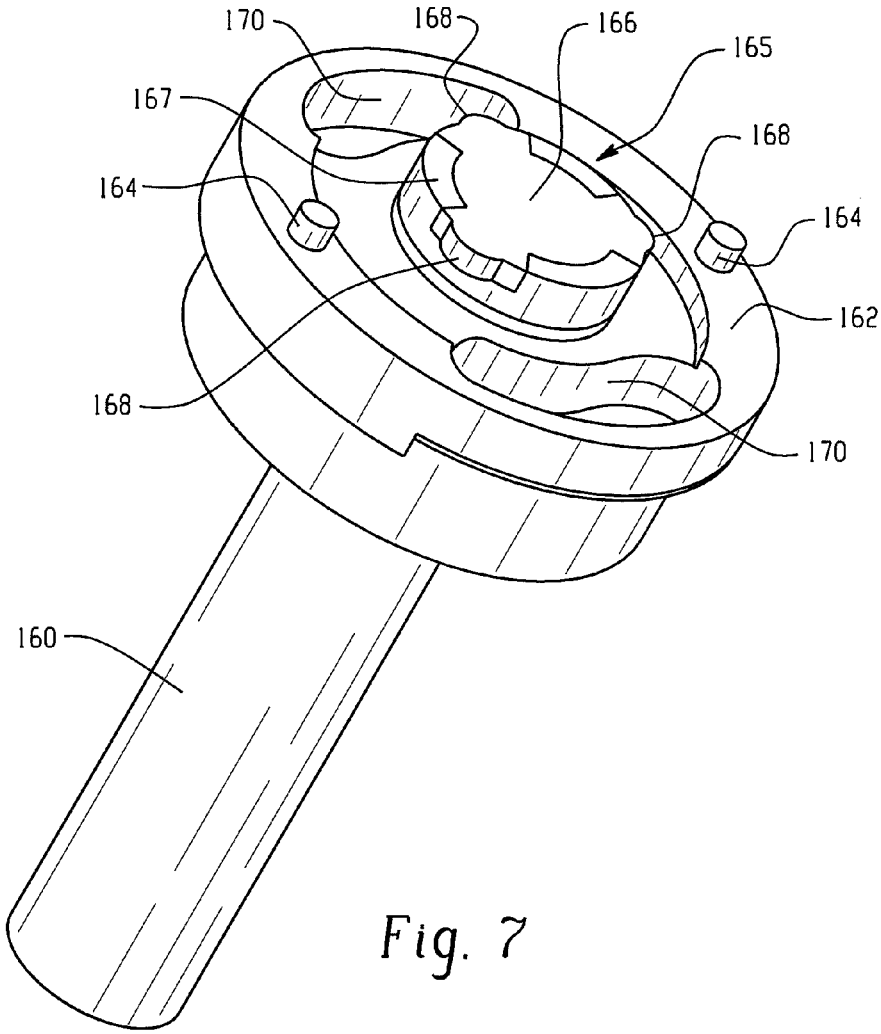
FIG. 7 is a perspective of a food product slicer knife mount hub.
Figure 8:
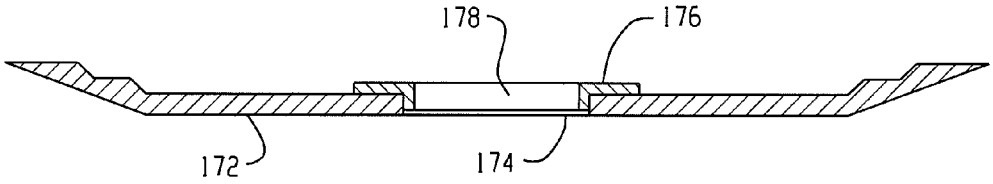
FIG. 8 is a cross-section of a knife and clamp plate.
Figure 9:
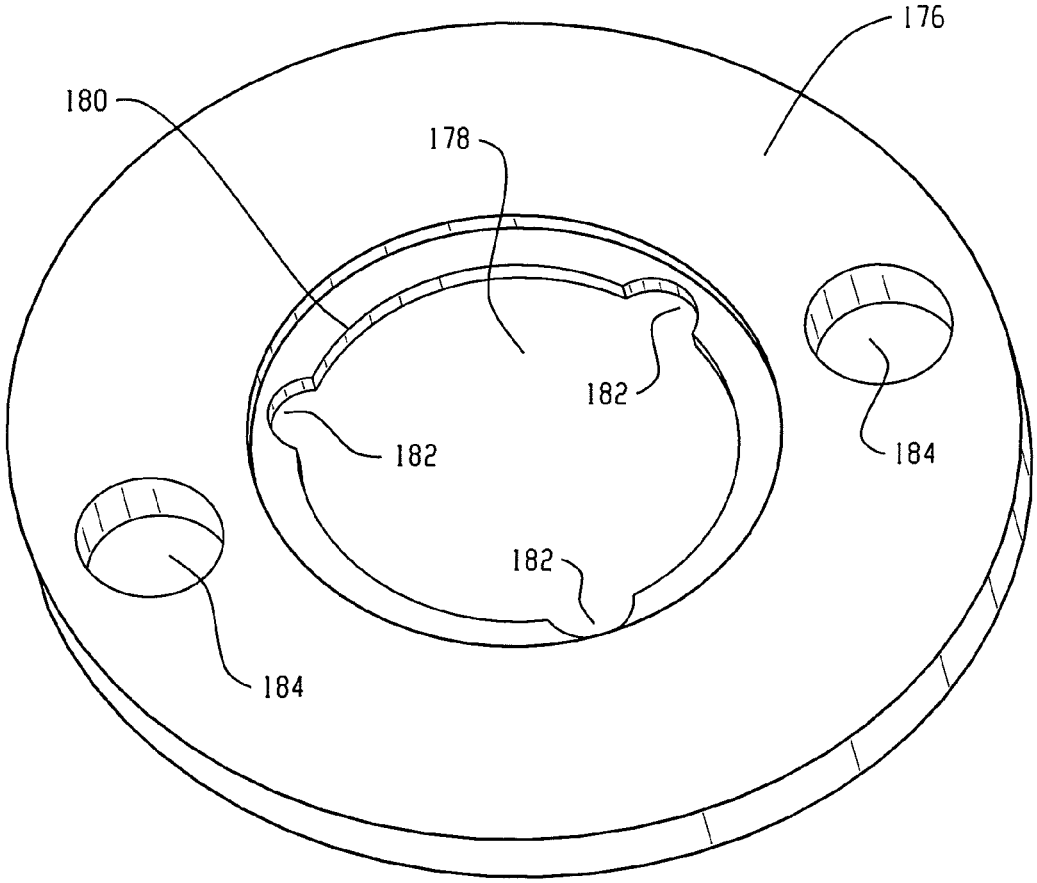
FIG. 9 is a perspective of the clamp plate.

Referring to FIG. 7, a drive shaft 160 and associated mounting hub 162 for a slicer knife is shown. The mounting hub includes diametrically opposed drive pins 164 for engaging corresponding pin openings in the knife (e.g., one of the sets 210 or 212 of diametrically opposed knife openings shown in FIG. 11) to transfer rotational movement to the knife. Referring again to FIG. 7, a central mount 165 includes a fixed hub portion 167 and a spring-loaded cap 166. The spring-loaded cap (which may be considered a clamp portion) is biased downward against fix hub portion 167, as by an internally located spring member, and includes projections 168 (3 equally spaced in the illustrated embodiment) extending radially outward beyond the outer edges of the fixed hub portion 167. Slots 170 are also provided. FIG. 8 shows a knife 172 with a central opening 174 into which a clamp plate 176 with a central opening 178 is inserted. The central opening 178 includes three arcuate side portions 180 spaced apart by three outward slots 182 as seen in FIG. 9. In the illustrated embodiment the slots are equally spaced circumferentially. The clamp plate 176 also includes diametrically opposed openings 184 through which the spring-loaded pins of the knife removal tool can be placed when the openings 184 are aligned with corresponding outward diametrically opposed slots 185 (FIG. 11) of the knife opening 174.

Thus, the knife itself includes a structure in the form of a circular body with a peripheral cutting edge and a central opening 174 through the knife body. The central opening includes a pair of diametrically opposed outwardly extending slots 185. The knife body further includes at least one set of diametrically opposed drive pin receiving openings 210 and/or 212 spaced outwardly of the central opening 174 and circumferentially offset from the diametrically opposed outwardly extending slots 185. The drive pin receiving openings could also be formed as slots extending from the central opening 174. The central opening 174 includes arcuate edge portions that extend between the diametrically opposed outwardly extending slots 185. A diameter defined by the arcuate edges portions is between about 2.0 and about 2.5 inches, such as between about 2.1 and about 2.15 inches, and preferably about 2.125 inches. A distance between the centers of the diametrically opposed drive pin receiving openings is between about 2.5 and about 2.6 inches, and preferably about 2.56 inches. A removal/installation tool pin receiving opening 173 is also located in the knife body and is located with its center between about 4.0 and 4.5 inches from a center of the central opening 174, such as between about 4.2 and about 4.3 inches, and preferably about 4.25 inches. A clamp plate 176 is seated in the central opening 174 of the knife body and is rotatable relative to the knife body. The clamp plate includes an outer portion overlapping edges of the central opening 174 and an inner portion extending downward into the central opening 174 (per FIG. 8). The clamp plate 176 includes a center opening 178 with three arcuate side edges 180 separated by three outwardly extending slots 182. The clamp plate also includes a pair of diametrically opposed openings 184 spaced outwardly of the center opening 178, which openings 184 are used to receive drive pins of the slicer mount hub.

Figure 10:
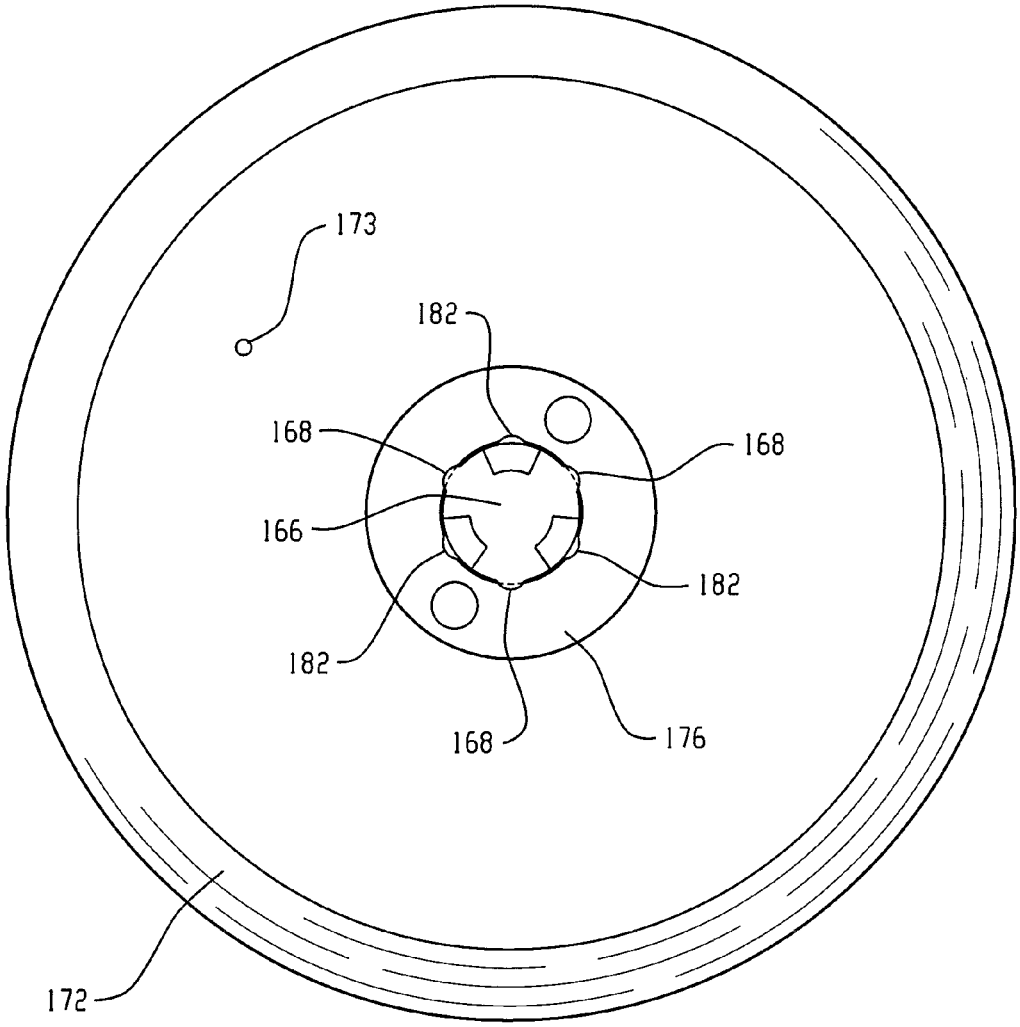
FIG. 10 is a top view of a knife and clamp plate mounted to the mount hub.

The knife 172 is mounted to the slicer by aligning the slots 182 on the clamp plate 176 with the projections 168 on the spring-loaded cap 166, pressing the knife downward so that the projections 168 move through the slots 182 and the pins 164 move into pin-receiving openings on the knife, then rotating the clamp plate 176 (e.g., by rotating handle 138 of the tool assembly clockwise sixty degrees) so that the projections 168 overlap with lip portions 186 on the clamp plate 176 to hold the knife on the slicer (see FIG. 10).

Figure 11:
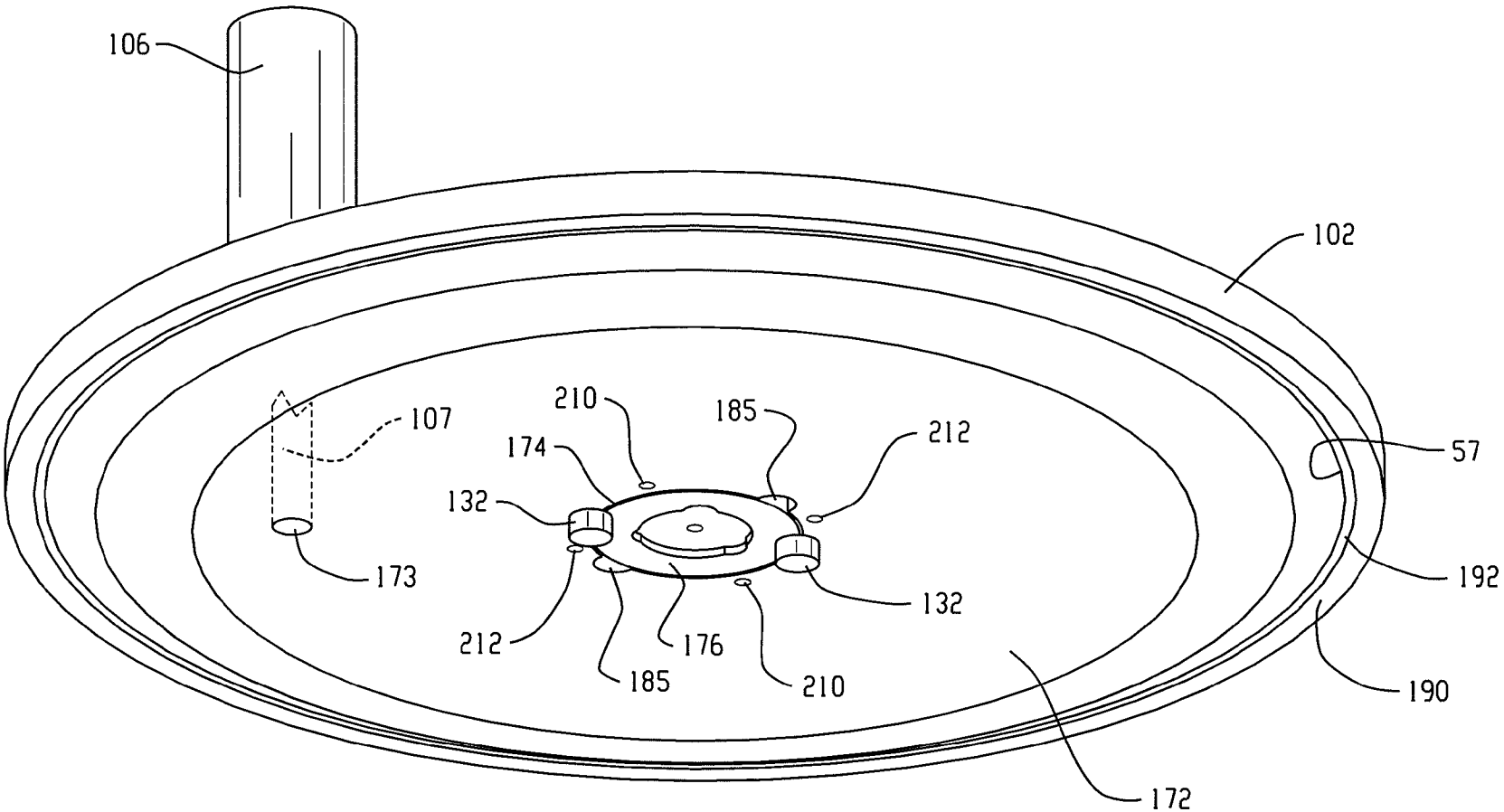
FIG. 11 is a bottom perspective of a knife mounted with the slicer knife removal and installation tool assembly.

To remove the knife from the slicer, the pins 132 of the knife removal tool are inserted into the aligned clamp plate holes 184 and knife holes/slots 185, pressing (to move pins 116) and rotating the handle 138 counterclockwise sixty degrees to rotate the clamp plate 176 (note that the pins 132 include radially outward facing slotted portions 133 (FIG. 3) that allow such rotation when the pins 132 have been pushed appropriately through the aligned holes 184 and 185), thereby aligning the slots 182 (FIG. 9) on the clamp plate 176 to the projections 168 of the cap 166 (FIG. 7). The handle 106 (FIG. 6) is used to prevent rotation of the tool body 102 during rotation of handle 138. By pulling the handle 138 away from the plane of the knife the knife is then removed from the slicer mount, while at the same time being connected to the knife removal tool for ease of handling as shown in FIG. 11. The knife is held by the spring loaded pins 132 to the knife removal tool via the engagement of the inner edge of knife opening 174 in the slotted portions of the pins 132. The knife can be reloaded onto the slicer via a reverse sequence of the removal operations using the tool assembly.

When the knife is connected to the tool assembly, the cutting edge of the knife is protected by the base 102, specifically a downwardly extending lip 190 of the base. In a preferred arrangement the lip 190 is sized so that the knife cutting edge 57 will be recessed slightly relative the lower edge of the lip 190 (e.g., located slightly upward relative to the lip in the view of FIG. 11 where the knife is positioned against the lower side of the base 102) so that the cutting edge of the knife The inner face of the lip may be at the peripheral edge of the base or may be located slightly radially inward of the peripheral edge to permit the lip to also extend circumferentially in the regions of the notches 200 (e.g., see FIG. 6). Referring again to FIG. 11, a suitable gap 192 may be provided between the inner face of the lip 190 and knife cutting edge 57 to permit water to flow for purposes of cleaning, but to still prevent undesired physical contact with the knife edge. In this regard, the openings 104 (FIG. 2) in the base also permit water flow around the knife. The outer edge portion of the knife can be maintained in spaced apart relationship from the knife-facing side of the base 102 to facilitate such water flow. The spring-loaded pins (not shown) and pin 107 of the knife removal tool prevent rotation of the handle 138 and rotation of the knife 172 while the knife is being carried by the tool.

The tool and mounting technique make it easier to install and remove the knife from the slicer. It is easier to clean the slicer after the knife is removed (e.g., due to the access openings 104 (FIG. 2) of the base 102, the gap 192 (FIG. 11) provided and the fact that the entire tool and knife assembly can be readily placed in a wash sink or dishwasher etc).

It is to be clearly understood that the above description is intended by way of illustration and example only and is not intended to be taken by way of limitation. Variations are possible. For example, in another embodiment the tool handle 106 (FIG. 2) may be eliminated, while keeping the pin 107 to prevent relative rotation between the knife and the base 102. In such an embodiment, the peripheral notches 200 in the base 102 may align and interact with corresponding structure that projects from the slicer base (e.g., pins 202 of FIG. 1) so that the base 102 will be prevented from rotating relative to the slicer base during rotation of the handle 138 of the tool assembly. Moreover, while the openings 104 of the base are shown as 4 relatively large openings, it is contemplated that a larger number of radially extending, more narrow openings could be provided, or different configurations of openings could be provided. Other changes and modifications could be made.

What is claimed is:

1. A food product slicer knife, comprising a circular knife body with a peripheral cutting edge, a central opening through the knife body, the central opening including a pair of diametrically opposed outwardly extending slots, the knife body further including at least one set of diametrically opposed drive pin receiving openings circumferentially offset from the diametrically opposed outwardly extending slots;

a clamp plate seated in the central opening of the knife body and rotatable relative to the knife body, wherein the clamp plate includes an outer portion overlapping edges of the central opening and an inner portion extending downward into the central opening, the clamp plate further including a center opening, wherein the center opening includes three arcuate side edges separated by three outwardly extending slots; and wherein the clamp plate further includes a pair of diametrically opposed openings spaced outwardly of the center opening.

2. A food product slicer knife, comprising a circular knife body with a peripheral cutting edge, a central opening through the knife body, the central opening including a pair of diametrically opposed outwardly extending slots, the knife body further including at least one set of diametrically opposed drive pin receiving openings circumferentially offset from the diametrically opposed outwardly extending slots, and a clamp plate seated in the central opening of the knife body and rotatable relative to the knife body, wherein the clamp plate includes diametrically opposed openings outward of a center opening, the diametrically opposed openings of the clamp plate alignable to overlap with the diametrically opposed outward extending slots of the central opening of the knife body.

3. The food product slicer knife of claim 2 wherein the opening includes arcuate edge portions extending between the diametrically opposed outwardly extending slots, a diameter defined by the arcuate edges portions is between about 2.0 and 2.5 inches.

4. The food product slicer knife of claim 3 wherein a distance between the diametrically opposed drive pin receiving openings is between about 2.5 and 2.6 inches.

5. The food product slicer knife of claim 4 wherein the knife body further includes a removal/installation tool pin receiving opening therethrough, the removal/installation tool pin receiving opening located between about 4.0 and 4.5 inches from a center of the central opening.

6. The food product slicer knife of claim 2 wherein the clamp plate includes an outer portion overlapping edges of the central opening and an inner portion extending downward into the central opening.

7. The food product slicer knife of claim 6 wherein the center opening includes three arcuate side edges separated by three outwardly extending slots.

8. The food product slicer knife of claim 2 wherein the drive pin receiving openings are spaced outwardly of the central opening.

9. A food slicer knife removal and installation tool assembly, in combination with the slicer knife of claim 2, comprising:

a base including a knife receiving side and a handle side, the base including a plurality of openings therethrough to permit water flow from the handle side to the knife receiving side, the base further including a circumferential lip extending downwardly from knife receiving side; and a handle assembly connected to the handle side of the base and rotatable relative to the base, the handle assembly including at least one knife engaging pin that is biased upward from the handle side of the base but movable through an opening in the base; and the slicer knife of claim 2 connected with the base such that the circumferential lip of the base protects the cutting edge of the slicer knife, the knife engaging pin extending through the opening in the base and securing the knife to the receiving side of the base.

10. The assembly and knife combination of claim 9 wherein a diameter defined by the inward face of the lip is sized to provide a small gap between the cutting edge and the inward face to permit water flow through the gap during knife cleaning operations.

11. The assembly and knife combination of claim 9 wherein the base further includes one or more peripheral notches.

12. A food product slicer, including the slicer knife of claim 2, comprising:

a base;

a knife mount hub located on the base for rotation by a drive shaft;

the slicer knife mounted to the knife mount hub for rotation relative to the base;

a carriage assembly mounted to the base for reciprocal movement back and forth past a cutting edge of the slicer knife;

the knife mount hub includes a central mount with a fixed portion and clamp portion movable in a direction along an axis of the drive shaft, the clamp portion biased toward a seated position against the fixed portion, the clamp portion including a central axis and having a peripheral edge with multiple spaced projections extending radially outwardly therefrom and beyond the outer edges of the fixed portion.

13. The food product slicer of claim 12 wherein the knife mount hub further includes a pair of diametrically opposed knife drive pins located radially outwardly of the central mount.

14. The food product slicer of claim 13 wherein the knife mount hub further includes a pair of slots located radially outwardly of the central mount and circumferentially offset from the knife drive pins.

15. The food product slicer of claim 12 wherein the slicer knife is held to the knife mount hub via the spaced projections of the clamp portion.

* * * * *